United States Patent [19]

Adams

[11] 4,056,420

[45] Nov. 1, 1977

[54] HEATING STRUCTURE FABRICATING MACHINE AND METHOD

[75] Inventor: Gerald E. Adams, Mishawaka, Ind.

[73] Assignee: Bristol Products, Inc., Bristol, Ind.

[21] Appl. No.: 650,050

[22] Filed: Jan. 19, 1976

Related U.S. Application Data

[62] Division of Ser. No. 503,924, Sept. 6, 1974, Pat. No. 3,964,959.

[51] Int. Cl.[2] ..... H05B 3/00

[52] U.S. Cl. ..... 156/181; 29/611; 156/296; 219/213;549

[58] Field of Search ..... 156/181, 296, 306, 290, 156/300, 177, 176, 178; 29/611; 338/210, 208, 212; 428/198, 296; 219/549, 213

[56] References Cited

U.S. PATENT DOCUMENTS

| | | | |
|---|---|---|---|
| 3,356,835 | 12/1967 | Watson | 219/549 |
| 3,658,627 | 4/1972 | Kaminsky | 156/306 |
| 3,659,338 | 5/1972 | McFarlane | 338/212 |
| 3,733,428 | 5/1973 | Fry | 156/178 |
| 3,949,111 | 4/1976 | Pelletier | 156/181 |

*Primary Examiner*—William A. Powell
*Assistant Examiner*—Michael W. Ball
*Attorney, Agent, or Firm*—Marmaduke A. Hobbs

[57] ABSTRACT

A method of fabricating heating structures in which a heating wire having a thermoplastic outer layer is arranged in a predetermined pattern and one or more strands of thermoplastic material are applied to the individual sections and bonded thereto. The area near the bond is heated to a temperature sufficient to fuse the surfaces of the wire and strand or strands and, after the wire and strands have cooled, the strands adhere to the sections, thus forming an integrated heating structure from the separate heating wire sections and thermoplastic strands. The sections may be parallel to one another and the strands applied thereto in substantially right angle relationship, and when a number of strands are applied to the wire sections, they normally are applied simultaneously and in parallel relation.

7 Claims, 7 Drawing Figures

Fig. 5
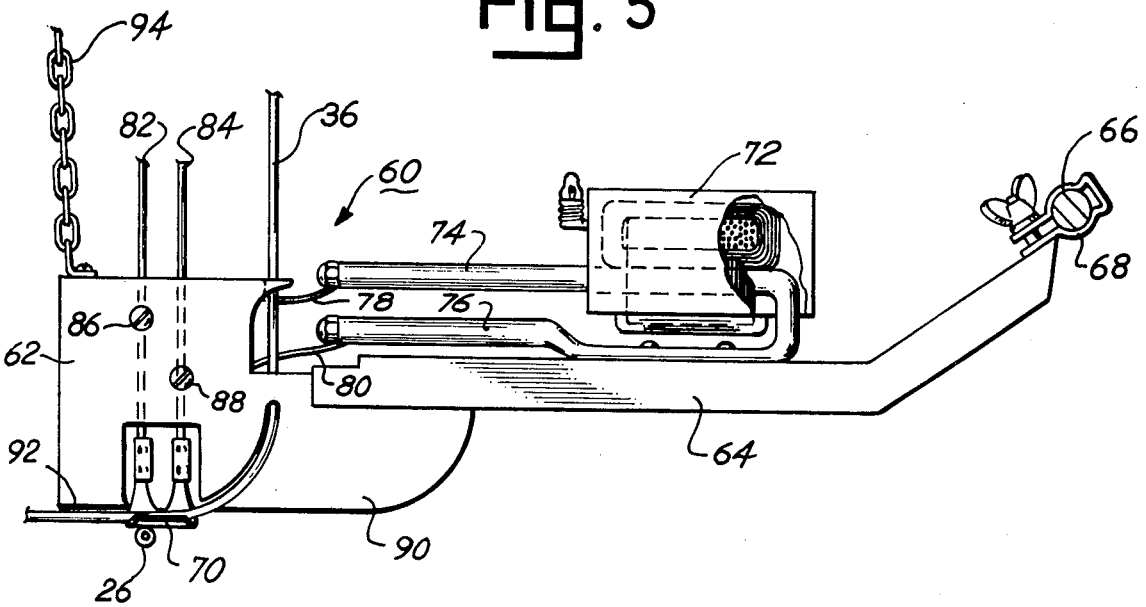
Fig. 6
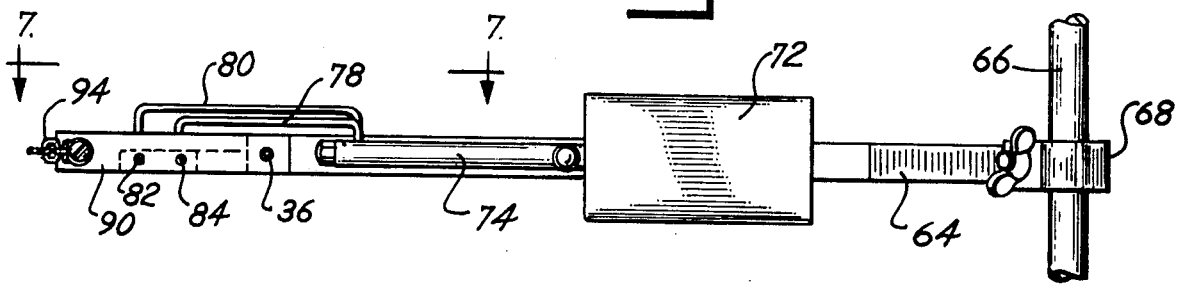
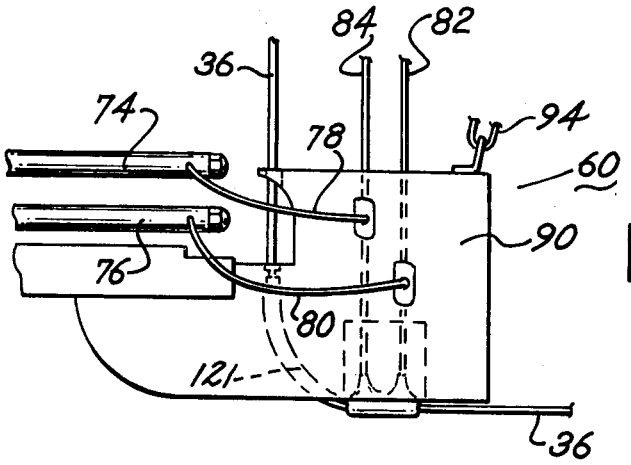
Fig. 7

HEATING STRUCTURE FABRICATING MACHINE AND METHOD

This application is a division of copending application Ser. No. 503,924 filed Sept. 6, 1974 now U.S. Pat. No. 3,964,959 issued June 22, 1976.

Heating structures and mats for embedment in pavement, walks, steps and ramps and in the earth or fill dirt beneath concrete floors or other types of pavement, have been constructed by a variety of different method and with different types of structural characteristics. A well known and widely used type consists of securing resistance heating wire to metal wire mesh using clips or the like to secure the heating wire in a predetermined pattern to one side of the wire mesh, and another type consists of a layer of plastic mesh on which the heating wire is mounted and secured by fusing the plastic strands of the mesh with the plastic insulation of the heating wire, by physically securing the wire to the plastic mesh by pressing the outer layer of insulation of the heating wire into gripping relationship with the strands of the mesh, or by using an adhesive disposed between the heating wire and mesh strands, or using two layers of mesh with the heating wire disposed between and held in place by the intermittent fusion of the two layers. These prior structures and methods have had certain inherent disadvantages and difficulties which have rendered them unsatisfactory and/or uneconomical to make, install or operate. More recently a heating structure has been invented consisting of an electrical resistance heating wire having a thermoplastic coating and being arranged in a predetermined circuitous pattern, and several strands of thermoplastic laid, usually in straight lines, from one section of the heating wire to the other, and joined to the heating wire by the application of heat, thereby holding the wire in its predetermined pattern. This structure and method are not only simple in construction and efficient to operate but easy and economical to fabricate, store, ship and install. It is one of the principal objects of the present invention to provide a machine for producing this latter heating structure which will produce this type of structure rapidly, simply and economically, and which is easy to operate without requiring any special training or skills.

Another object of the invention is to provide a heating structure fabricating machine which is simple in construction and capable of producing a structure of any desired length, and which can be adapted to produce heating structures of the aforesaid type with various predetermined heating wire configurations and with different numbers of holding strands for the wire sections.

A further object of the invention is to provide a machine for producing heating structures of the foregoing recently developed type having heating wire with thermoplastic insulation and strands of thermoplastic material, which will automatically apply the required heat and pressure to the strands and wire to bond the two together after the wire has been arranged in a predetermined pattern and which operates effectively to join the wire and strands, not withstanding variations in pattern made in the heating structure while being fabricated.

Additional objects and advantages of the present invention will become apparent from the following description and accompanying drawings, wherein:

FIG. 5 is an enlarged side elevational view of a heating unit used in the machine;

FIG. 6 is a top plan view of the heating unit shown in FIG. 5; and

FIG. 7 is a fragmentary side elevational view of the side of the unit opposite that shown in FIG. 5.

Figure 1:
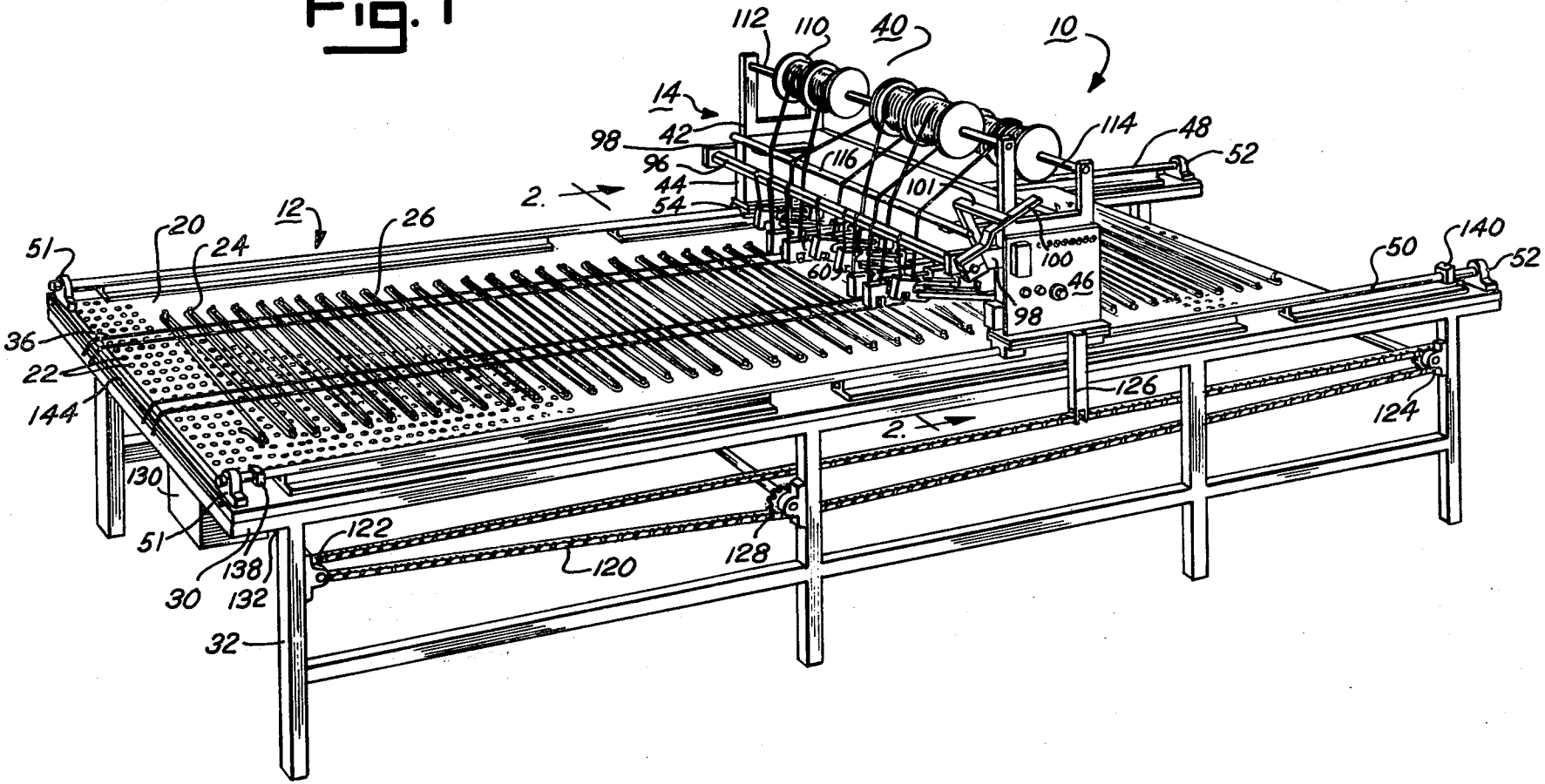
FIG. 1 is a perspective view of a heating structure fabricating machine embodying the present invention.
Figure 2:
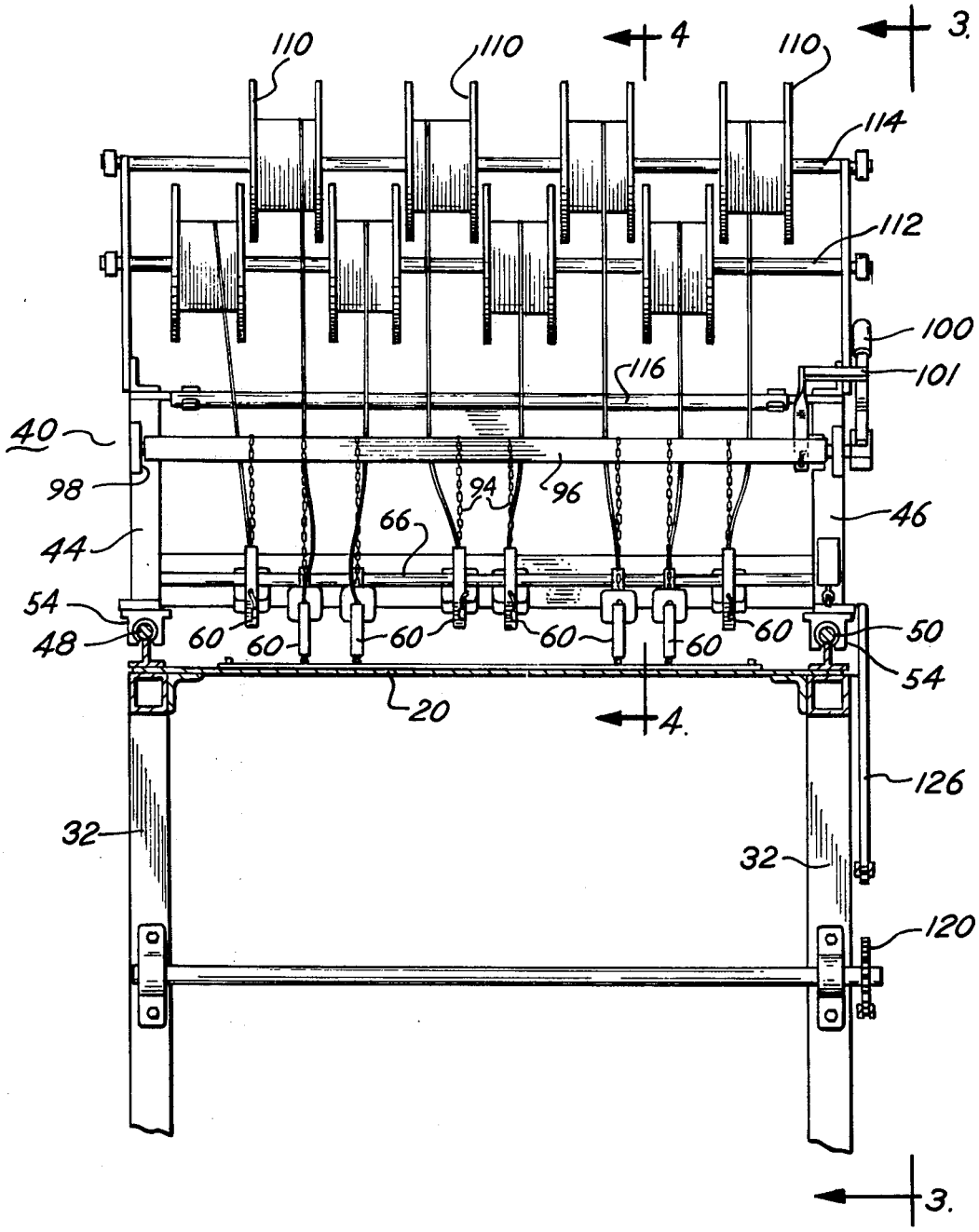
FIG. 2 is a vertical cross sectional view through the machine, the section being taken on line 2—2 of FIG. 1.
Figure 3:
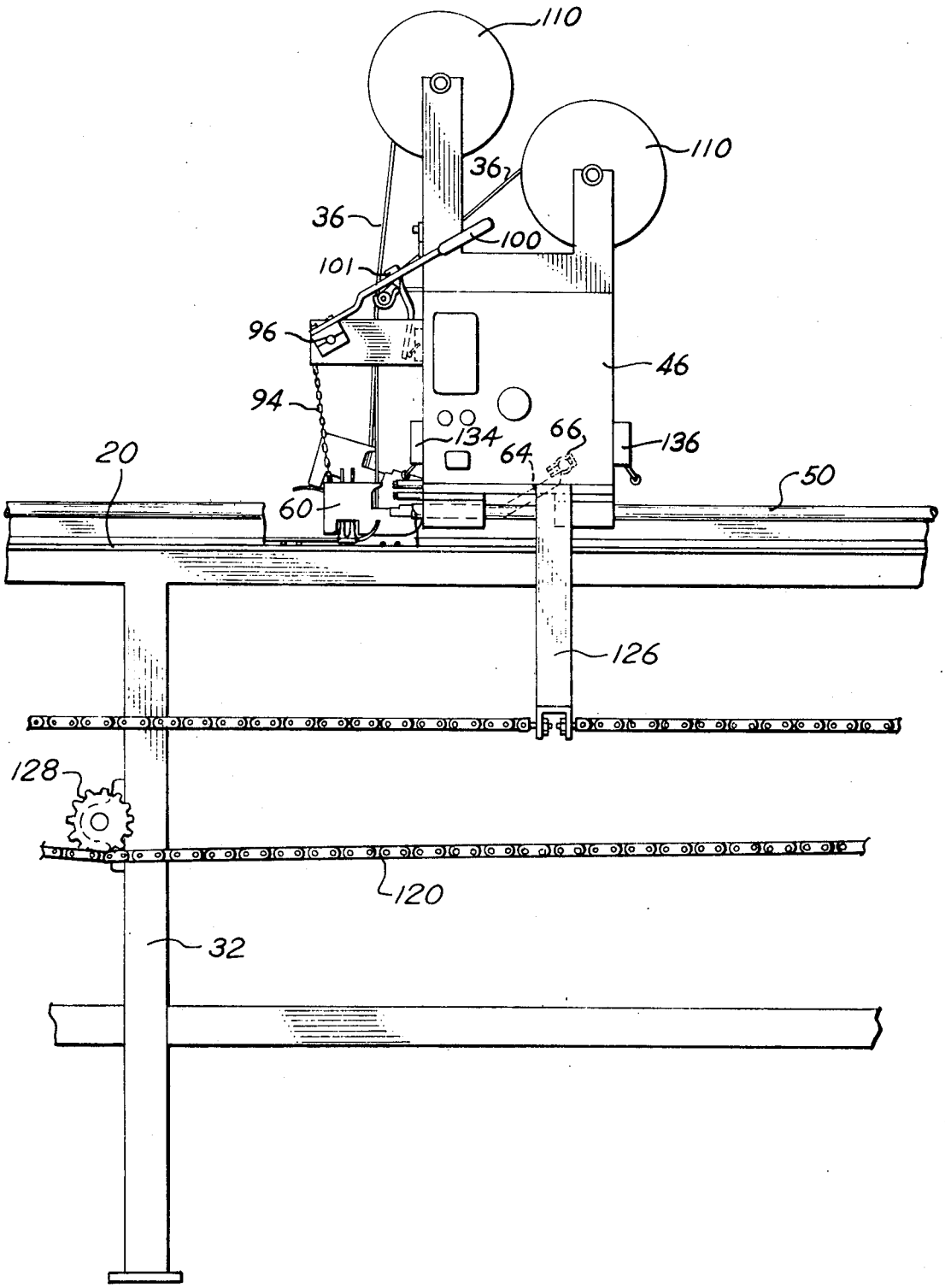
FIG. 3 is a fragmentary side elevational view of the machine, as viewed from the line indicated by numerals 3—3 of FIG. 2.
Figure 4:
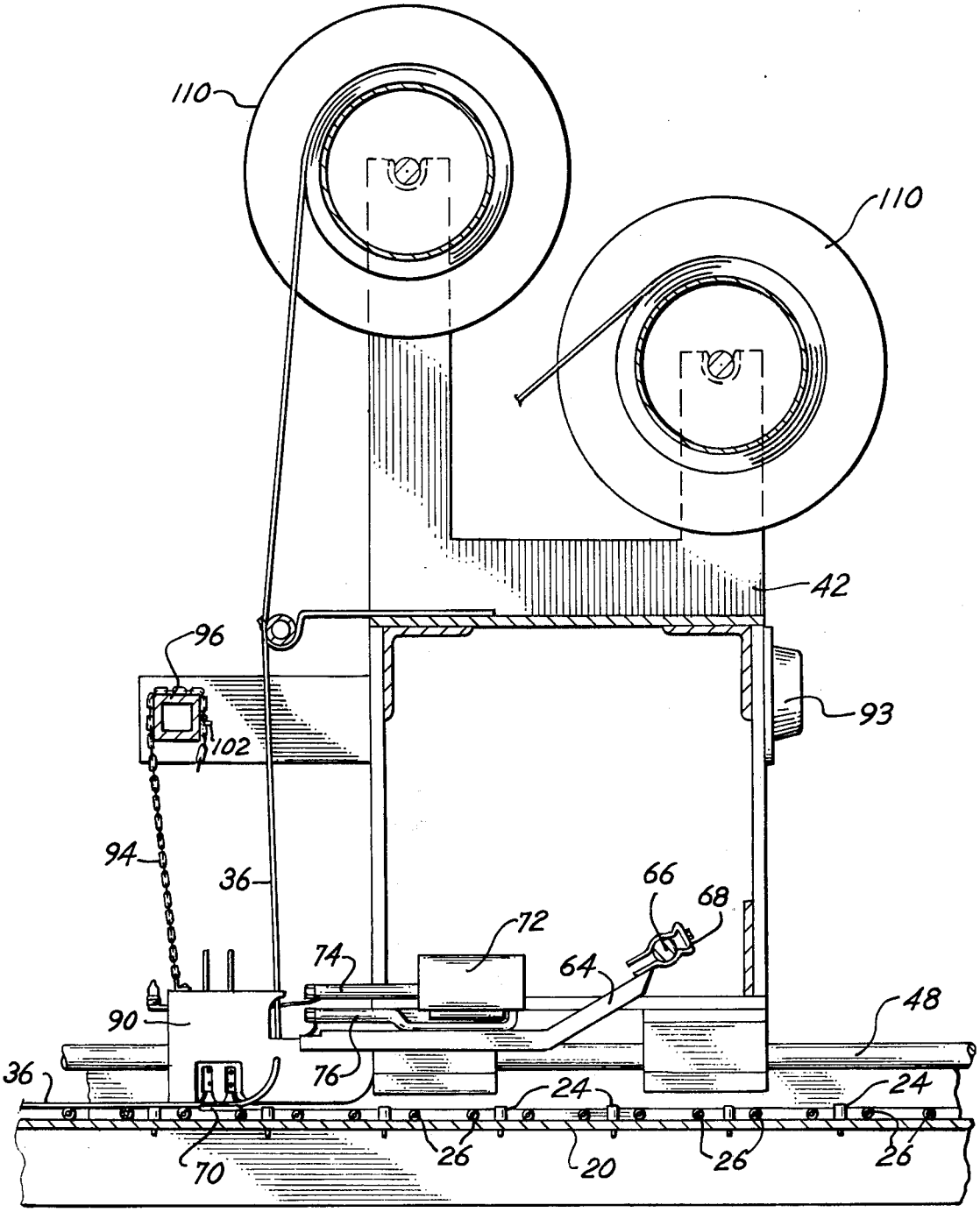
FIG. 4 is a fragmentary vertical cross sectional view of the machine, the section being taken on line 4—4 of FIG. 2.

Referring more specifically to the drawings and to FIG. 1 in particular, numeral 10 indicates generally the heating structure fabricating machine embodying the present invention, numeral 12 designates a table on which the heating structure is fabricated and 14 a carriage for heating units used in the fabrication of the heating structure. The type of heating structure fabricated on the present machine is disclosed in my U.S. Pat. No. 3,904,847, the heating structure consisting generally of an electrical resistance heating wire having an insulation of thermoplastic material and being placed in a predetermined pattern such as the serpentine pattern shown in FIG. 1. The transverse sections of the heating wire are held in their predetermined pattern by carrier strands of thermoplastic material joined to the surface of the heating wire, thus forming a flexible structure which can be rolled, folded or otherwise shaped to the contour of the driveway, floor, steps or other pavement or material in which the unit is embedded. The heating structure of this type is used primarily for heating concrete floors by placing the units in the earth beneath the floor or in a pavement for a driveway, walk or in step structures. When the electrical resistance wire is energized, it produces sufficient heat to maintain the concrete floor or driveway at the desired temperature. When the heating structure is in the floor it is intended primarily as a source of heat for heating the space above the floor. When the structure is placed in the driveway, walk or steps it is primarily intended to maintain the temperature above freezing to melt snow and to prevent the formation of ice thereon. The heating structure or mat formed by the present fabricating machine may be of various shapes and have transverse sections of the heating wire of different lengths forming, in effect, cut out sections for adapting the heating structure to the structure of the building or driveway in which it is installed, thus providing, for example, a "cut out" section for the space occupied by conduits, plumbing, posts and the like. Various configurations can be made to adapt the structure to the intended use.

In the embodiment of the present heating structure fabricating machine shown in the drawing, table 12 consists of a stationary top 20 having numerous spaced holes 22 in which pegs 24 are arranged in a desired pattern for receiving and holding the sections of heating wire identified by numeral 26. The heating wire is continuous from one end of the table to the other and is looped back and forth around the pegs on opposite sides of the table without overlapping any of the sections. The holes in the table permit the arrangement of pegs inwardly or outwardly to provide "cut out" portions or lateral extensions when the heating unit is being manufactured for a specific installation. However, when the heating element is being made for general use, the pegs are arranged in two laterally spaced straight rows, thus providing a final heating structure of a rectangular configuration. The table top may be of pressed wood, plywood or metal, whichever is desired, and is mounted rigidly on a table frame 30 having a plurality of legs 32 along each side of such a length that the table top is approximately the same height as that for a conventional table, thus permitting the operator of the machine to loop conveniently the heating wire around the pegs to form the desired configuration. The wire used in the construction of the heating structure requires a thermoplastic outer layer; however, the remainder of the layer may be of any desired composition and structure.

The carrier strands 36 which hold the sections of wire 26 in the desired configuration are applied to the heating wire strung on the table by the operation of carriage 40, the carriage consisting of a frame 42 having end plates 44 and 46 which are mounted on rails 48 and 50, respectively. The rails are supported at their ends by brackets 51 and 52 on the corners of the table. In the embodiment illustrated, the rails are round rods and bearings 54 are secured to the bottom of plates 44 and 46 and glide on the rods, thereby permitting the carriage to move freely from one end of the table to the other. The carrier strands 36 are applied by heating units or guns 60 which are mounted on the carriage between side plates 44 and 46, each consisting of a head 62 supported by an arm 64 which in turn is supported by a rod 66 extending between the two plates 44 and 46, the arm being secured to the rod by a fixture 68. The carrier strand is heated by an electrical heating element 70 connected to a transformer 72 mounted on arm 64 and connected to the element by rods 74 and 76 and wires 78 and 80 and rods 82 and 84, the two wires being connected to the rods 82 and 84 by screws 86 and 88, respectively. The two rods 82 and 84 are connected to element 70, thus completing the circuit through the transformer to the element. The transformer provides a low voltage high current for heating the element 70 sufficiently to fuse the outer surface of the carrier strand 36 and the adjacent section of heating wire 26. The body 90 of unit 60 is preferably constructed of plastic and is provided with a smooth bottom surface 92 which contacts the upper surface of carrier strand 36 and presses it into the fused surface of the heating wire, as the unit moves over the heating wire. The weight of the body and the heating components mounted on arm 64 provide sufficient pressure to effectively join the carrier strands and heating wire. Each of the transformers 72 controlled by knobs 93 has a variable transformer (not shown) on the carriage to vary the temperature of the elements in accordance with the speed of the carriage relative to the table top.

In the embodiment of the invention illustrated in the drawings, eight heating units are mounted on the carriage, and are supported in operating position by a chain 94 connected to an operating bar 96 pivotally mounted in brackets 98 and operated by a handle 100 and latch 101. When the handle is pressed downwardly as viewed in FIG. 1, rod 96 is rotated, thereby winding chain 94 thereon sufficiently to lift the heads of the heating units from the heating wire on the table. While eight heating units are shown on the carriage, often only four of the heads may be used at any one time. In order to render the heads inoperative and prevent them from interfering with fabrication of the structure, they are lifted by shortening respective chains 94, using pin 102 to select a required link in the chain. While normally four carrier strands are adequate to form an effective heating structure, there may be some installations in which all eight of the heads may be used, or it is possible that in some installations, a greater number of carrier strands would be desirable. The carriage can be moved over the heating wire a second time to secure additional strands to the wire sections.

The carrier strands are on spools 110, one spool being used for each heating unit, and the spools are mounted on rods 112 and 114 which are supported at their ends by vertical extension members of frame 42. As the strands leave the spools, they pass over a rod 116 and enter the head 62 of the heating unit through a channel 121 and pass along in contact with the upper surface of the trough-shaped element 70. The lower surface of the element contacts the heating wire, thereby permitting the element to simultaneously heat the lower surface of the carrier strands and the upper surface of the heating wire. Thus, as the head moves away from the heating wire section, i.e. toward the right as viewed in the drawings, the heated carrier strand immediately contacts the fused area of the heating wire and is passed firmly in contact therewith by the weight of body 90, thus causing the fused surfaces of the strand to contact the fused surface of the heating wire and to join the two together. The thermoplastic layer on the strand and heating wire cool and solidify rapidly, thereby forming an effective joint immediately after the strand leaves element 70 as the carriage moves toward the right on rails 48 and 50. The carrier strands 36 may be merely of thermoplastic material; however, they preferably contain a metal wire on fiberglass core to prevent stretch of the strand.

The carriage is driven along the table from one end to the other end by a drive consisting of a chain 120 trained on sprockets 122 and 124 mounted on legs 32 at opposite ends of the table. The chain is connected to the carriage by an arm 126 which is rigidly connected to the cariage and pivotally connected to the chain. An idle sprocket 128 is preferably provided to maintain the proper tension on the chain. A motor and gear reduction unit in a housing 130 is mounted on the underside of the table top and is connected to sprocket 122 by a shaft 132. The motor is reversible, thereby permitting the carriage to be driven readily in either direction from one end of the table top to the other. Limit switches 134 and 136 are provided on opposite sides of the carriage and are operated on cams 138 and 140 mounted on opposite ends of track 50. These switches, which are in the drive motor control circuitry, stop the carriage when it has reached either of the two ends. The speed of the carriage may be variable by a suitable variable transformer and control for the drive motor. Controls for the various heating units are mounted on plate 46 and, while the control for the motor may likewise be mounted on the carriage, it may be located at any other convenient place.

In the operation of the heating structure fabricating machine just described, carriage 40 is moved to the far right as viewed in the drawings, thus fully exposing the table top, since the table top does not extend fully to the right hand of the table. After the pegs have been placed in the position to give the desired heating structure configuration, the heating wire is looped back and forth over the pegs to provide a pattern such as that shown in FIG. 1. Several pegs may be spaced inwardly or outwardly from the row if desired to provide either an indentation or an extension in the final heating structure. After the wire has been placed in the preferred configuration, from one end of the table to the other or in a shorter length if desired, the carriage 40 is moved by the motor driving chain 120 to the left hand end of the table. Four strands on the carriage are threaded through the head and element 70 and then fastened at the end of the table. In this embodiment, a coiled wire spring 144 is used to hold the ends of the carrier strands. While the ends of the strands are held in this manner, the carriage is moved by the motor along rails 48 and 50 toward the right hand end of the table. As the carriage moves, elements 70 heat the strands as the strands move downwardly through channels 121 and through the trough on the upper surface of the elements. The elements being hot, fuse the lower surface of the carrier strands and simultaneously fuse a small area of the upper surface of the heating wire. As soon as the carriage has moved sufficiently to the right to pass away from the particular heating wire section, the fused areas of the strands and heating wire are pressed together by the surface 92 of body 90, causing the fused areas to adhere to one another. Upon cooling, which occurs readily after the heating unit has passed beyond the heating wire, the strands are firmly secured to the heating wire. After the carriage arrives at the right hand end of the table, lever 100 is pressed downwardly and locked into position by latch 101, thus lifting the heads of the heating units and holding them in spaced relation to the heating structure. The heating structure is then removed from the table as a unit and the heating wire is again strung on the pegs preparatory to the fabrication of a second heating structure.

While the machine is shown as having a movable carriage and a stationary table on which the heating wire is placed, the carriage may be stationary and the table top consist of an endless belt mounted on rollers or pulleys at each end of the table with the pegs arranged thereon in a manner similar to that used on the flat table top 20. In the use of this modified form, the heating wire can be placed on the pegs as the endless belt rotates, and the carrier strands are attached to the heating wire as the wire sections pass beneath the heating units, thus resulting in a continuous operation for fabricating the heating structures. In this continuous operation, the heating structures are cut into sections of the desired length as they emerge completed at the left hand end of the machine. Various other modifications and changes may be made to satisfy requirements.

I claim:

1. A method of fabricating a heating structure using a heating element, the steps comprising arranging a heating wire with a thermoplastic outer layer in a predetermined pattern with transverse spaced sections, feeding a strand having a thermoplastic outer layer progressively to said sections in an angular, crosswise relationship while said strands and sections are below the temperature at which the surface thereof fuses, heating by direct contact with said heating element only the areas of said wire sections which are to be joined to the strand, to the fusion point before said strands and sections contact one another simultaneously heating said strands with said heating element to provide a fused area in the proximity of each of said heating wire sections, and pressing said fused areas of the strand and respective section together to form a bond between said wire and strand.

2. A method of fabricating heating structure as defined in claim 1 in which said sections are arranged in a serpentine pattern with the transverse sections of the heating wire being substantially parallel to one another and said strands are applied simultaneously and separately to said sections in a substantially right angle relationship therewith.

3. A method of fabricating a heating structure as defined in claim 1 in which a plurality of strands are fed to sections of the heating structure, and adjacent areas of the sections and strands are fused and pressed against one another to form a bond.

4. A method of fabricating heating structures as defined in claim 2 in which said heating wire is arranged in a serpentine pattern with the transverse sections of the heating wire being substantially parallel with one another.

5. A method of fabricating heating structures as defined in claim 3 in which the strands are pressed separately against the fused surface of the wire sections.

6. A method of fabricating heating structures as defined in claim 3 in which said strands are applied in a substantially right angle relationship with respect to said sections.

7. A method of fabricating heating structures as defined in claim 6 in which said plurality of strands are spaced from one another in a substantially parallel relationship.

* * * * *